US005935050A

United States Patent [19]

Shahan

[11] Patent Number: 5,935,050

[45] Date of Patent: Aug. 10, 1999

[54] BACK STRENGTHENING METHOD AND APPARATUS

[76] Inventor: Emory Lee "Buzz" Shahan, 1954 E. Glencove St., Mesa, Ariz. 85203

[21] Appl. No.: 08/862,541

[22] Filed: May 23, 1997

Related U.S. Application Data

[63] Continuation of application No. 08/525,953, Sep. 8, 1995, abandoned, which is a continuation-in-part of application No. 08/318,272, Oct. 5, 1994, abandoned.

[51] Int. Cl.[6] ..... A63B 26/00; A63B 23/02

[52] U.S. Cl. ..... 482/142; 482/140; 482/145

[58] Field of Search ..... 482/51, 140, 142, 482/145, 148, 109, 125, 134, 138, 92, 95

[56] References Cited

U.S. PATENT DOCUMENTS

| | | | |
|---|---|---|---|
| D. 296,808 | 7/1988 | Urbanc | D21/191 |
| 3,567,218 | 3/1971 | Johnson | 482/140 |
| 3,682,475 | 8/1972 | Walker | 482/140 |
| 4,324,399 | 4/1982 | Rickey | 272/144 |
| 4,332,381 | 6/1982 | Lyons | 482/140 |
| 4,755,539 | 7/1988 | Nieppola | 272/63 |
| 4,832,236 | 5/1989 | Lahman | 272/144 |
| 4,884,804 | 12/1989 | Fenwick | 482/140 |
| 4,913,424 | 4/1990 | Pepin | 272/144 |
| 4,927,135 | 5/1990 | Nieppola | 272/63 |
| 4,976,428 | 12/1990 | Ghazi | 272/134 |
| 5,176,603 | 1/1993 | Hundley et al. | 482/145 |
| 5,190,513 | 3/1993 | Habing et al. | 482/142 |

*Primary Examiner*—Stephen R. Crow

*Attorney, Agent, or Firm*—Laura J. Zeman; Snell & Wilmer, L.L.P.

[57] ABSTRACT

A method and apparatus for exercising and strengthening the back is presented which comprises a horizontal base member having a foot plate attached to one of its ends and a cylindrical shaped pad member vertically positioned and secured above the horizontal base member. The apparatus may also comprise a support plate attached to the base member opposite the foot plate, lateral handle bars extending from the cylindrical shaped pad, and means for adjusting the height of the cylindrical pad above the horizontal base member and means for adjusting the overall length of the apparatus when the support plate is included. During use, a user positions his hip area over the cylindrical pad and braces the soles of his feet against the foot plate. The user then alternately raises and lowers his upper torso from an inverted vertical position to a position that is planar with the rest of his body. Another preferred embodiment of the exercising apparatus comprising an inverted "U"-shaped tube with feet that are curved parallel to the floor. Two lateral supports on each foot, with safety caps on their terminal ends, provide lateral support. The horizontal crossbar of the inverted "U" is joined by a friction fit joint for easy disassemble and transportation. An infinitely adjustable foot plate is centered on the horizontal crossbar, while two lateral handles on the end of the crossbar provide lateral support for the user. Cylindrical pads cover the crossbar and the handles.

8 Claims, 5 Drawing Sheets

FIG. 5

52

| WEEK#_____ DATE_____ | BACK HEALTH PROGRAM | | | | | | | | | | | | | | | | | |
|---|---|---|---|---|---|---|---|---|---|---|---|---|---|---|---|---|---|---|
| | MON | | | TUE | | | WED | | | THRU | | | FRI | | | SAT | | |
| | | | | AEROBICS | | | | | | | | | | | | | | |
| SKIP ROPE – 1 MIN. /OR | | | | | | | | | | | | | | | | | | |
| BICYCLE – 2 MIN. /OR | | | | | | | | | | | | | | | | | | |
| BRISK WALK – 3 MIN. /OR | | | | | | | | | | | | | | | | | | |
| STAIR STEP – 1 MIN. /OR | | | | | | | | | | | | | | | | | | |
| OTHER | | | | | | | | | | | | | | | | | | |
| | REPS | | | REPS | | | REPS | | | REPS | | | REPS | | | REPS | | |
| SETS | 1 | 2 | 3 | 1 | 2 | 3 | 1 | 2 | 3 | 1 | 2 | 3 | 1 | 2 | 3 | 1 | 2 | 3 |
| | UPPER TORSO ISOMETRIC STRETCH AND FLEX | | | | | | | | | | | | | | | | | |
| NECK STRETCH FRONT DEEP | | | | | | | | | | | | | | | | | | |
| FRONT SHALLOW | | | | | | | | | | | | | | | | | | |
| SIDE TO SIDE LEFT | | | | | | | | | | | | | | | | | | |
| SIDE TO SIDE RIGHT | | | | | | | | | | | | | | | | | | |
| SIDE TO SIDE BODY STRETCH | | | | | | | | | | | | | | | | | | |
| FULL BODY TWIST | | | | | | | | | | | | | | | | | | |
| | | | | LOWER BACK AND TENDON STRETCH | | | | | | | | | | | | | | |
| DEEP SQUAT – LUMBAR STRETCH | | | | | | | | | | | | | | | | | | |
| BRACED PUSH UP | | | | | | | | | | | | | | | | | | |
| BRACED CALF STRETCH/TOE TOUCH | | | | | | | | | | | | | | | | | | |
| | | | | | | | | | | | | | | | | | | |
| REVERSE SIT – UP | | | | MUSCLE BUILDING | | | | | | | | | | | | | | |
| LEVEL 1 – HANDS ON FLOOR /OR | | | | | | | | | | | | | | | | | | |
| LEVEL 2 – HANDS ON LEGS OF BB /OR | | | | | | | | | | | | | | | | | | |
| LEVEL 3 – HANDS ON THIGH /OR | | | | | | | | | | | | | | | | | | |
| LEVEL 4 – HANDS ON HEAD /OR | | | | | | | | | | | | | | | | | | |
| LEVEL 5 – HANDS ON HEAD W/TWIST | | | | | | | | | | | | | | | | | | |
| LEG LIFTS | | | | | | | | | | | | | | | | | | |
| | | | | COOL DOWN | | | | | | | | | | | | | | |
| SEATED TOE TOUCH | | | | | | | | | | | | | | | | | | |

54

56

58

60

62

BACK STRENGTHENING METHOD AND APPARATUS

This application is continuation of a previous application U.S. Ser. No. 525,953 filed in the United States Patent and Trademark Office by Emory lee Shahan on Sep. 8, 1995, of the same title, and assigned U.S. Ser. No. 08/525,953, now abandoned, and a CIP of U.S. Ser. No. 08/318,272 filed Oct. 5, 1994, now abandoned.

BACKGROUND OF THE INVENTION

The present invention relates generally to an apparatus and method which aid in exercising the human body and enhancing the body's overall health. More particularly, the present invention relates to an apparatus specifically designed for performing reverse sit-ups and other exercises and a method for strengthening an individual's back muscles and enhancing the overall health of an individual's back.

Epidemiological studies have indicated that back pain afflicts approximately 60 to 80% of the population in the Western world. An estimated 75 million Americans currently suffer from back pain. In addition, over 16 million Americans visit their doctors each year because of back pain. This number does not include visits to chiropractors and other therapists who treat back pain.

Furthermore, the number of Americans in bed due to back pain on any single day is estimated at 6 million and an estimated 93 million workdays are lost every year in the United States due to back pain. The costs associated with back pain relating to diagnosis and treatment, loss of productivity, disability payments, Worker's Compensation, and lawsuits are high. The U.S. federal government estimates that approximately 14 billion dollars is spent on back pain each year.

Back pain can result from a number of problem areas in the back. Many problem areas are attributed to the degenerative process of the, spine which begins after the bones of the spinal column have reached their mature size. This usually occurs when an individual reaches their mid-twenties. However, although the degeneration of the spine can result in back pain, a great deal of back pain has been shown to be related to an individual's inactivity.

Spinal ligaments, the tough bands of Connective tissue that bind the vertebrae of the spine together, frequently begin to lose some of their strength as a result of inactivity and aging. When these ligaments become lax, thereby losing some of their ability to support the spine, it is very important to have strong muscles to compensate for their lack of spinal support. Unlike ligaments, muscles are extremely elastic and can therefore help to maintain the proper posture of the back. However, when the muscles associated with the spine become weakened from chronic strain and inactivity, they cannot perform their job in aiding the support of the back.

Therefore, in that today's lifestyles seldom include back strengthening activities, there is a need for a simple apparatus and method for strengthening the back muscles in order to enhance the overall health of the back and thereby reduce or eliminate back pain.

SUMMARY OF THE INVENTION

It is an object of the present invention to provide a simple apparatus and method for strengthening the muscles in an individual's back.

It is a further object of the present invention to provide a simple apparatus and method for strengthening the muscles in the back which is inexpensive and requires a minimum, but consistent, time commitment.

It is a still further object of the present invention to provide a simple apparatus and method for strengthening the back which can be adapted to any individual's age and level of capability.

It is yet a further object of the present invention to provide a back exercising apparatus which is sturdy enough to support a user yet easy to assemble and disassemble in order to facilitate transport and storage of the apparatus.

These and other objects, features and advantages of the present invention will become more apparent to those skilled in the art from the following more detailed description of the preferred embodiments taken with reference to the accompanying drawings.

BRIEF DESCRIPTION OF THE DRAWING

FIG. 5 is a chart showing an exercise program which employs the back exercising apparatus in accordance with the present invention.

DETAILED DESCRIPTION OF THE PREFERRED EMBODIMENT

Figure 1:
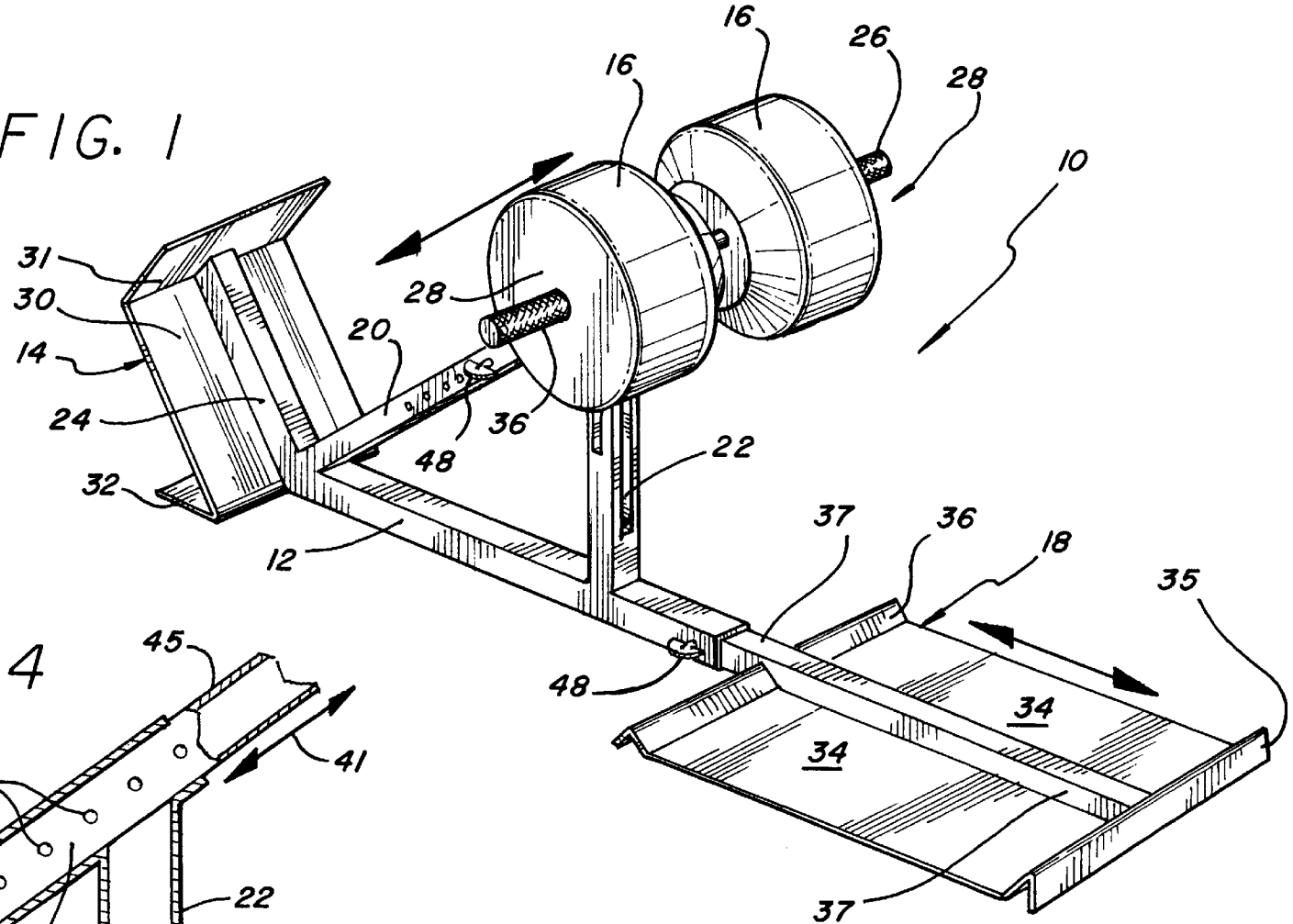
FIG. 1 is a perspective view of the preferred embodiment of the back exercising apparatus in accordance with the present invention.

Turning now to the preferred embodiment of the present invention with reference to FIG. 1, the back exercising apparatus 10 of the present invention generally comprises a horizontal base member 12, a foot plate 14, a pair of cylindrical pad members 16, and a support plate 18. The pair of cylindrical pad members 16 are vertically positioned and secured above the horizontal base member 12 by an angled support bar 20 and a vertical support bar 22. The foot plate 14 is attached to one end of the horizontal base member 12 and the support plate is attached to the opposite end of the horizontal base member 12. The horizontal base member 12 may be constructed with an angled portion 24 located at one of its ends so that the foot plate 14 can be secured to the angled portion 24 of the horizontal base member 12 for added stability. The pair of cylindrical pad members 16 are attached to one another via a rod member (not shown) and handle members 26 extend laterally from the outermost sides 28 of the cylindrical pad members 16.

The foot plate 14 and the support plate 18 are preferably constructed to enhance stability of the exercising apparatus 10. For example, the foot plate 14 preferably comprises a planar member 30 having first and second ends, a first planar lip member 31 extending perpendicular from one end of the planar member 30, and a second lip member 32 extending from the opposite end of the planar member 30 at an angle less than 90° relative to the planar member 30. Further, the support plate 18 preferably comprises a planar plate 34 having a first and second end and first and second ridge members 35,36 attached to the first and second ends of the planar plate 34, respectively wherein the first and second ridge members 35,36 comprise an elongated bar in the shape of an inverted "V" attached along a length of the first and second ends of the planar plate 34. The support plate 18 may also comprise a bar 37 which extends along a middle length of the planar plate 35 and beyond the second ridge member 36 of the support plate 18 such that it may fit within a hollow end of the horizontal base member 12.

In order to accommodate different sizes of users, the angled support bar 20 is adjustable in length so that a user's feet can press against the foot plate 14 when the user's hip area is positioned over the cylindrical pad members 16. Further, the support plate 18 is adjustable along a length of the horizontal base member 12 so that the overall length of the back exercising apparatus 10 can be increased and thereby stabilized in accordance with an increased length in the angled support bar 20. One example of a means for adjusting these lengths is described later with reference to FIG. 4 which illustrates a pin and slot mechanism. Other means for adjusting the length of the angled support bar 20 and the overall length of the back exercising apparatus 10 could comprise a friction fit mechanism with internal stops or notches, a screw type mechanism, or any other length adjusting mechanism that is know in the prior art.

To use the preferred embodiment of the back exercising apparatus 10 of the present invention, a user positions his hip area over the cylindrical pad members 16 and braces the soles of his feet against the foot plate 14. The user then performs a reverse sit up using the apparatus 10 by inverting his upper torso portion so that his head extends downward toward the horizontal base member 12, and then lifting his upper torso to a position where it is planar with the lower half of his body as if he were laying in a planar position on his stomach. The exercise apparatus can also be used for a variety of other exercises by using the support plate 18 and handle members 26 of the apparatus 10.

Figure 2:
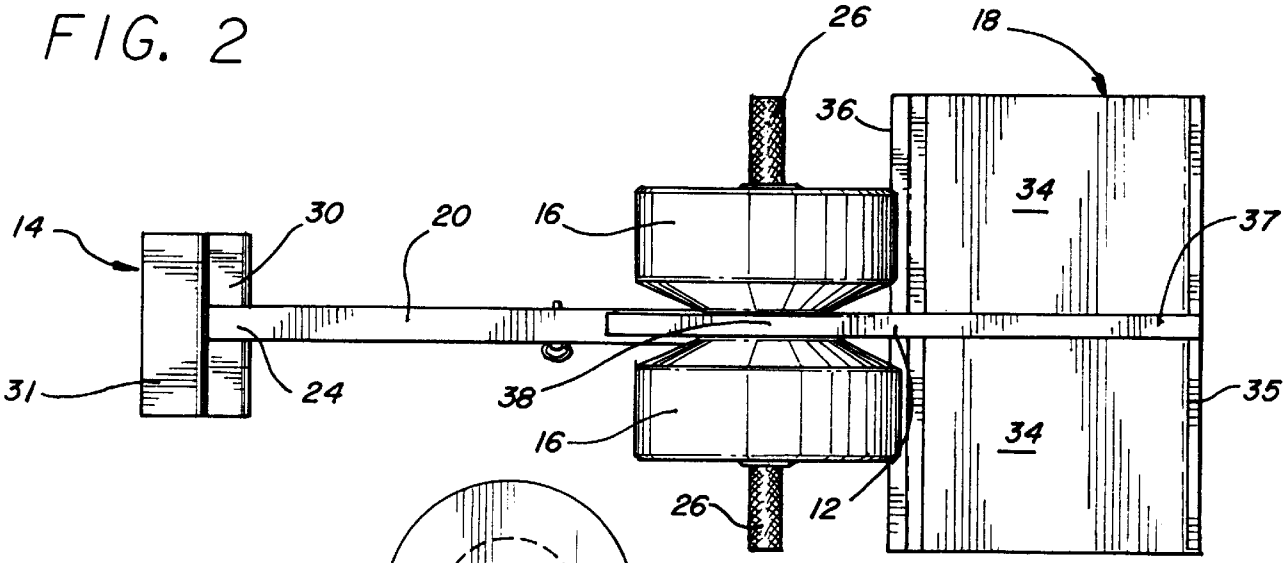
FIG. 2 is a top elevational view of the preferred embodiment of the back exercising apparatus in accordance with the present invention.

FIG. 2 illustrates a top elevational view of the preferred back exercising apparatus 10 of the present invention. From FIG. 2, it can be seen that the angled support bar 20 and the vertical support bar 22 are in direct alignment above the horizontal base member 12. The cylindrical pad members 16 are positioned such that the center connection point 38 between the pad members 16 lies in direct alignment above the horizontal base member 12. Further, FIG. 2 easily shows how the back exercising apparatus 10 is stabilized by virtue of the configuration and placement of the foot plate 14 and the support plate 18, and the symmetrical alignment of the pad members 16 about the horizontal axis of the back exercising apparatus 10.

Figure 3:
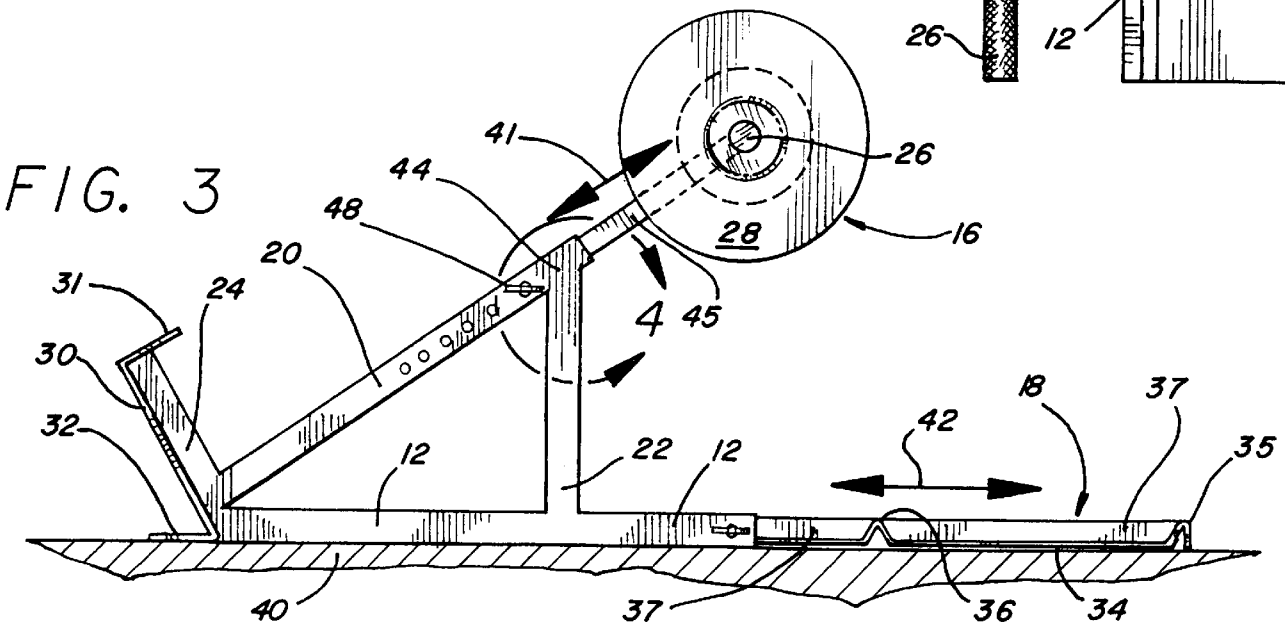
FIG. 3 is a partial side elevational view of the preferred embodiment of the back exercising apparatus in accordance with the present invention.
Figure 6:
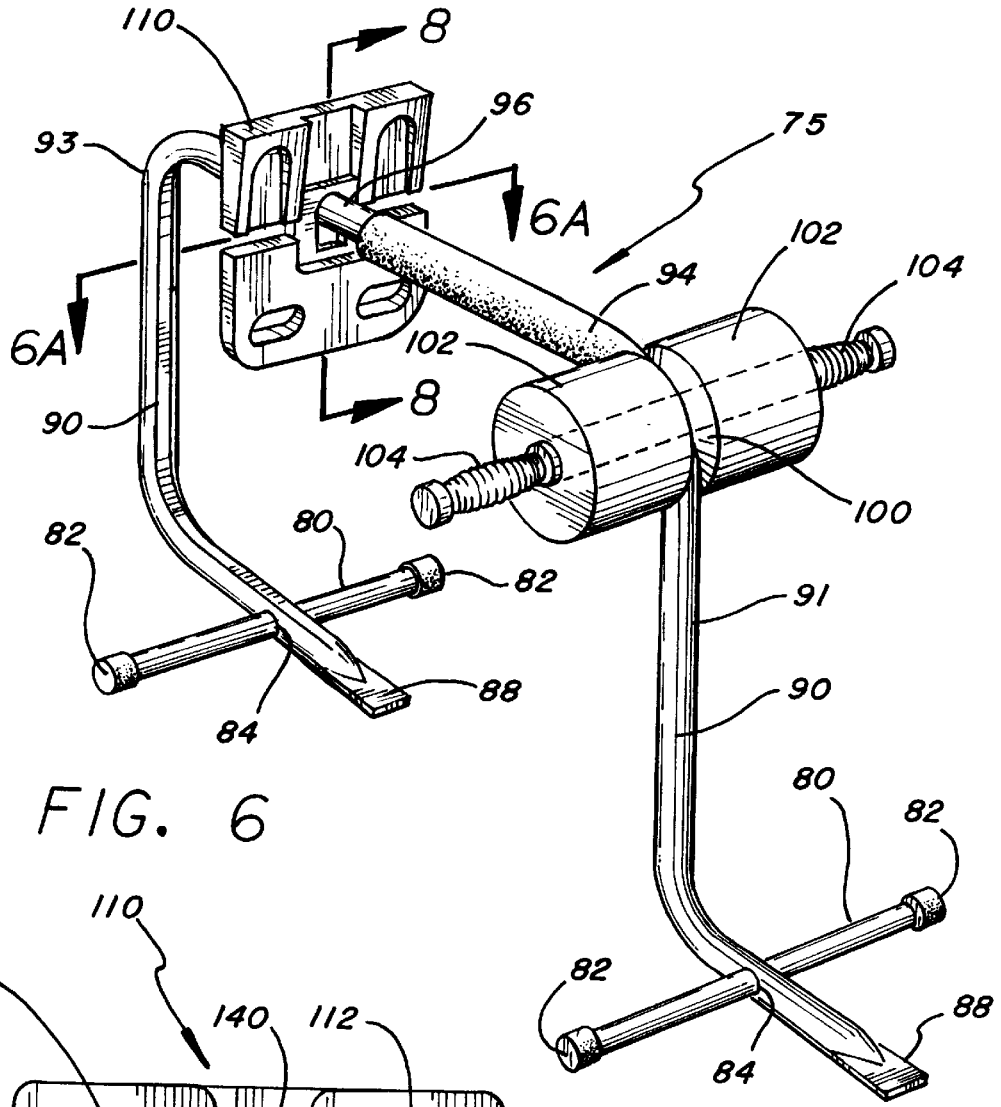
FIG. 6 is a perspective view a second embodiment of the back exercising apparatus in accordance with the present invention.
Figure 7:
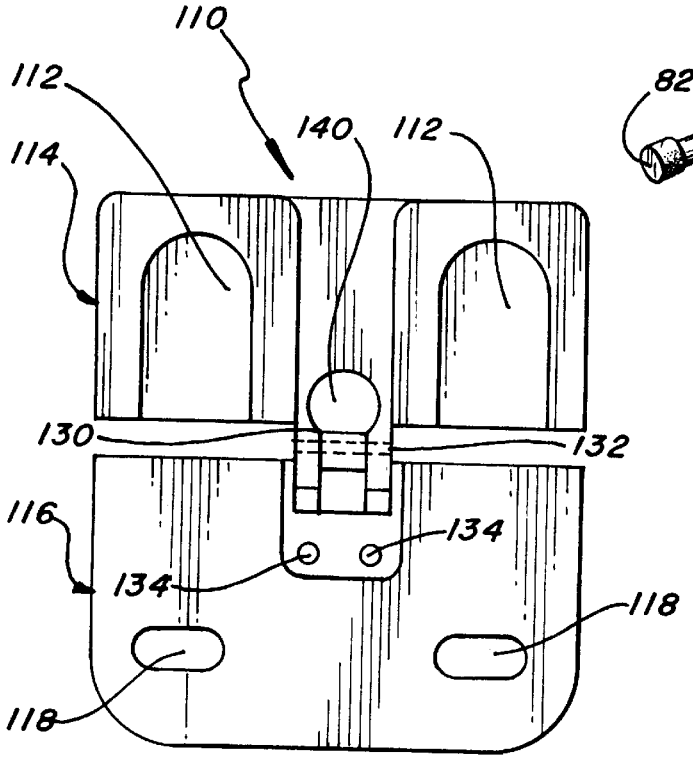
FIG. 7 is a top view of the adjustable foot plate of the second embodiment of the present invention.
Figure 6A:
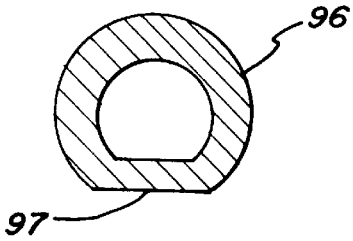
FIG. 6A is a cross-sectional view taken along line 6A—6A of FIG. 6.

A partial side elevational view of the preferred embodiment of the back exercise apparatus 10 of the present invention positioned on the floor or ground 40 is shown in FIG. 3. The direction of the adjustable length of the angled support bar 20 is indicated by line 41 and the adjustable length of the back exercising apparatus 10 which is achieved by extending the length of the support plate 18 from the horizontal base member 12 is indicated by line 42. The angles at which the first and second planar lip members 31,32 extend from the planar member 30 of the foot plate 14 are also clearly shown in FIG. 3. As previously stated, the first planar lip member 31 of the foot plate 14 extends from the planar member 30 of the foot plate 14 at a right angle while the second planar lip member 32 of the foot plate 14 extends from the planar member 30 of the foot plate 14 at an angle less than 90° relative to the planar member 30 of the foot plate 14.

Figure 4:
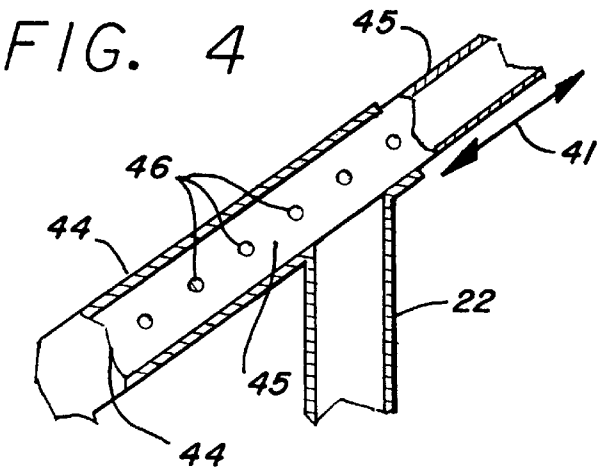
FIG. 4 is a cross-sectional view taken along line 4—4 of FIG. 3 of the area referenced by numeral 4.

Means for adjusting the length of the angled support bar 20 is designated by the circled area referenced with the numeral 4. A cross-sectional view of that encircled area is depicted in FIG. 4. As can be seen in FIG. 4, in order to possess an adjustable length, the angled support bar 20 comprises a first hollow bar member 44 having a hole therethrough near its end that is nearest the cylindrical pad members 16 and a second bar member 45 having a plurality of openings 46 therethrough which fits within the hollow bar member 44. The second bar member 45 is slid out from the first hollow bar member 44 to a desired length. In order to secure the second bar member 45 within the first hollow bar member 44, a pin 48 is inserted through the opening in the first hollow bar member 44, through one of the plurality of openings contained within the second bar member 45, and back through the same opening in the first hollow bar member 44. This same means for adjusting length is utilized when adjusting the overall length of the back exercising apparatus 10. However, in adjusting the overall length of the back exercising apparatus 10, the bar 37 of the support plate 18 contains a plurality of openings and is slidably engaged within the horizontal base member 12.

The preferred embodiment of the back exercising apparatus 10 of the present invention is preferably comprised of three distinct pieces: 1) one continuous piece which comprises the horizontal base member 12, the foot plate 14, the first hollow bar member 44 of the angled support bar 20 and the vertical support bar 22, 2) one continuous piece which comprises the second bar member 45 of the angled support bar 20 and the pair of cylindrical pad members 16, and 3) one continuous piece which comprises the support plate 18 including its bar 37. These three distinct pieces facilitate assembly, disassembly, transportation, and storage of the back exercising apparatus.

The back exercising apparatus 10, with the exception of the cylindrical pad members 16 and the handle members 26, is preferably comprised of a sturdy lightweight metal which is capable of being machine cut and molded into the desired configurations previously described. The cylindrical pad members 16 are preferably comprised of a sturdy foam or cushioning material which is slightly deformable in that is "gives in" slightly when pressure is directly applied to it. The handle members 26 are preferably comprised of a rubber or similar material which facilitates gripping.

Although the back exercising apparatus 10 is particularly designed for enabling a user to efficiently and effectively perform reverse sit-ups, the back exercise apparatus 10 is also a part of a unique exercise program 52 which is specifically designed for training the muscles in the back to adjust to performing increasingly modest amounts of work. This exercise program 52 is shown in the form of a chart in FIG. 5. The exercise program 52 focuses on exercises which are divided into groups. The first group of exercises 54 comprise a choice of an aerobic exercise. The second group of exercises 56 isometrically stretches and flexes the upper torso. The third group of exercises 58 stretches the lower back and tendons. The fourth group of exercises 60 builds the muscles associated with the back and is mostly comprised of sets of repetitions of reverse sit-ups which increase in difficulty. The back exercising apparatus 10 is employed to carry out these reverse sit-ups. A seated toe touch is performed as a cool-down exercise 62.

In performing the first exercise group 54, the user selects one form of aerobic exercise as represented by an increased heart rate from resting heart rate.

1. Rope skipping for 1 minute;
2. Bicycling for 2 minutes;
3. Brisk walking for 3 minutes;
4. Stair stepping for 1 minute; or
5. Other aerobic exercise, such as running, swimming or simulated skiing for 2 minutes.

The first group of exercises 54 is performed only on the first, third and fifth days of each six consecutive day period.

In the second group of exercises 56, the user sequentially performs the following exercises which provide isometric stretching and flexion for the upper torso:

1. Neck stretching, consisting of:
   a. Front deep neck stretch;
   b. Front shallow neck stretch;
   c. Side-to-side left neck stretch;
   d. Side-to-side right neck stretch;
2. Side-to-side body stretch;
3. Back arch-shoulder stretch; and
4. Full body twist.

In and overall fitness program, the exercise will perform three repetitions of each exercise in the first group of exercises six consecutive days each week.

The third 58 and fourth 60 exercise groups are each performed after completion of the second exercise group 56. However, these exercise groups are performed only on the first, third and fifth days of each six consecutive day period.

The third exercise group 58 exercises the lower back and connective tendons. In performing this second exercise group 56, the user will sequentially perform three repetitions each of the following exercises:

1. Deep squat-lumbar stretch;
2. Braced push-up; and
3. Braced calf stretch and toe touch.

Upon completion of the third exercise group 58, the exerciser will perform the fourth group of exercises 60 which isolate and build the muscle groups of the back. In performing this fourth exercise group 60, the user will perform three repetitions one of exercises 1–5 as follows, followed by exercise 6:

1. Reverse sit-up with hands on floor;
2. Reverse sit-up with hands on the legs of the exercise device 10 or 75;
3. Reverse sit-up with hands on thighs;
4. Reverse sit-up with hands on head;
5. Reverse sit-up with hands on head and twisting torso; and
6. Leg lifts.

Upon completion of all exercise groups each day, the exercise them performs seated toe touches during the cool down period 62.

Figures 8A, 8B, 8C:
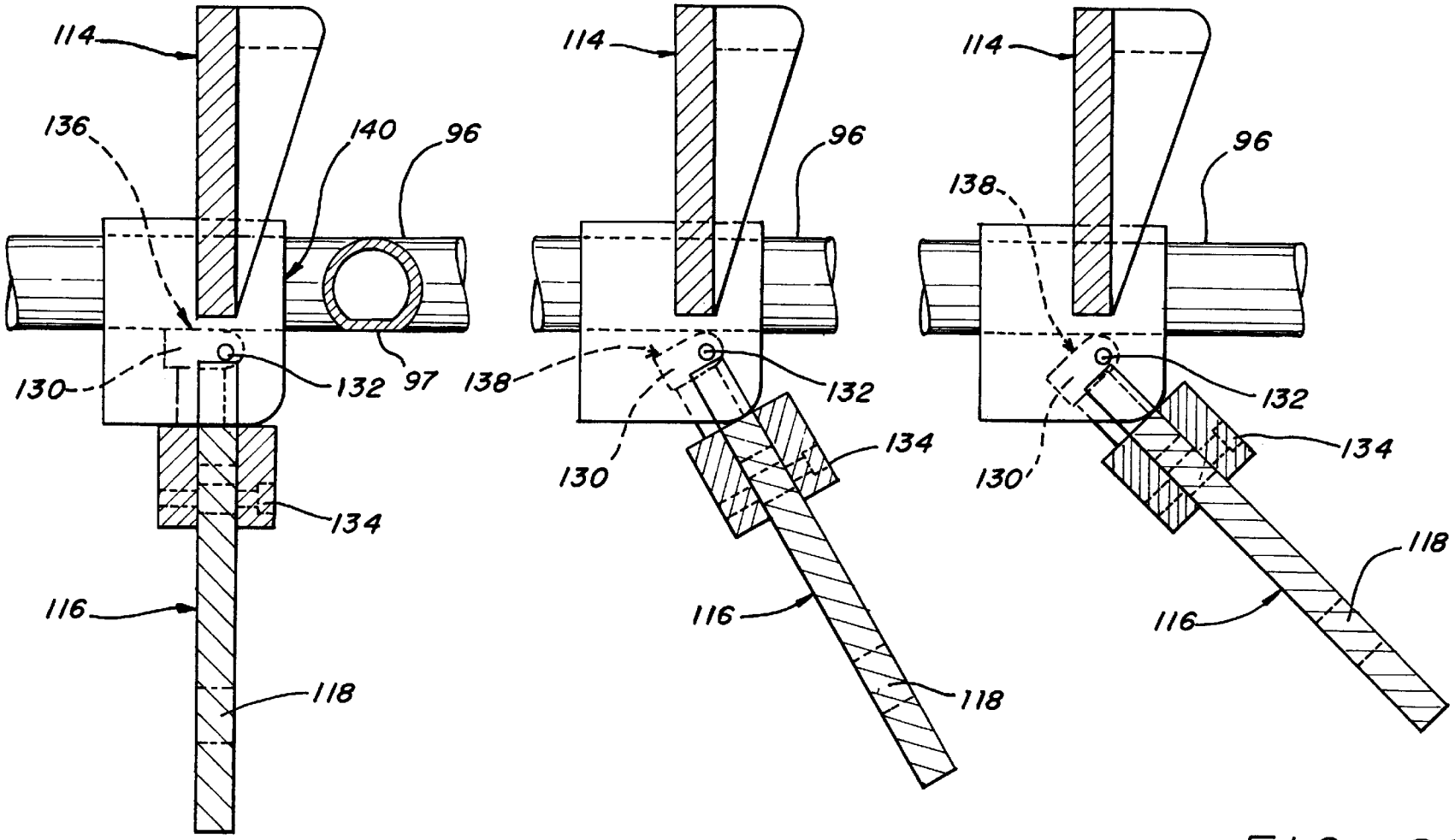
FIG. 8A is a cross-sectional view of the second embodiment taken along line 8—8 of FIG. 6 showing the foot plate securely engaged to the crossbar.
FIG. 8B is a cross-sectional view of the second embodiment of the present invention showing the foot plate disengaging from the crossbar.
FIG. 8C is a cross-sectional view of the second embodiment of the present invention showing the foot plate disengaged from the crossbar.

Turning now to a second preferred embodiment of the present invention with reference to FIGS. 8–10 there is shown the inventive back exercise apparatus 75 which consists primarily of an inverted "U"-shaped tube 91 having a crossbar member 96 and downwardly depending feet 90 positioned at forward and rearward aspects of the crossbar member 96. Feet 90 depend from crossbar 96 and curve downwardly from crossbar 96 extending to the floor. As illustrated in FIG. 8A, the tubular structure 91 has a flattened lower portion 97 which extends the length of the crossbar member 96. Each of feet 90 terminate with a forwardly extending flattened and flared head 88 to provide longitudinal stability. Two lateral supports 80 are threaded by a male/female coupling 84 through a lateral opening and bushing in the intermediate portions of each foot 90 to provide lateral stability. Safety caps 82 cover the terminal ends of the lateral supports 80. Crossbar member 96 is preferably assembled from two discrete tubular members consisting of forward 91 and rearward 93 tubular members. Forward tubular member 91 includes the forward lateral support 80 and handles 104 bearing a cylindrical pad 102 thereupon. Rearward tubular member 93 bears an adjustable footplate 110 thereupon and the rearward lateral support 90. This configuration allows for easy disassembly and transportation of the apparatus. Those skilled in the art will understand, however, that division of the exercise apparatus 75 into forward and rearward members is desired, but not essential to the present invention. An axially positioned cylindrical pad 94 is also provided and engaged upon crossbar member 96 to provide a cushion and guard against injury to the user.

An infinitely adjustable foot plate 110 is centered about the horizontal crossbar 96 through a circular opening 140 on the foot plate 110. Circular opening 140 operatively engages the crossbar 96 and has a flattened lower aspect to mate with the flattened lower portion 97 of crossbar member 96. The upper portion 114 of the foot plate includes recesses 112 for the placement and retention of the user's heals. The lower portion 116 of the foot plate 110 is connected to the upper portion 114 by bolts 134. A cam 130 carrying a pin 132 in its center for rotation thereabout is provided to provide frictional engagement of foot plate 110 to crossbar member 96. Cam 130 is affixed to, or integral with, the lower portion 116 of foot plate 110 by bolts 134. When the foot plate 110 is in use, the cam 130 is fictionally engaged 136 against the flattened portion 97 of the crossbar and the foot plate is perpendicular to the floor. To adjust the foot plate 110, the lower portion 116 is rotated upward, which disengages the cam 130 from the flattened portion 97 of the crossbar 96, so the foot plate 110 can be easily slid along the horizontal crossbar 96.

Two oval openings 118 on the lower portion 116 of the foot plate 110 are provided to allow the user to grasp the foot plate to accomplish positional adjustment of the foot plate 110.

Two laterally extending handles 104 are provided to facilitate mounting and dismounting onto the exercise apparatus 75. Handles 104 are threaded via a male/female coupling 100 and pass through a lateral opening 100 in the forward end of the crossbar 96 and provide a location for the user's hands to grasp during mounting, dismounting and use of the apparatus. It is preferable to provide plastic grips which cover the distal portion of the handles 104 and serve to cushion the user's pelvic region and act as a fulcrum while the user is performing the reverse sit up exercise.

While the preferred embodiments of the invention have been shown and described, it will be apparent to those skilled in the art that various changes and modifications may be made without departing from the true spirit and scope of the present invention. For that reason, the scope of the present invention is set forth in the following claims.

While the preferred embodiments of the invention have been shown and described, it will be apparent to those skilled in the art that various changes and modifications may be made without departing from the true spirit and scope of the present invention. For that reason, the scope of the present invention is set forth in the following claims.

I claim:

1. An exercise apparatus comprising:

a horizontal base member having first and second ends;

a foot plate attached to one of said first and second ends of said horizontal base member and extending from said horizontal base member at an angle less than 180°;

a planar support plate attached to the end of said horizontal base member opposite the foot plate wherein said planar support plate lies parallel to the floor and comprises a length and width greater than said foot plate and lipped edges traversing the width of the planar support plate along top and bottom edges of said support plate to prevent a user's feet from sliding off of the planar support plate;

at least one cylindrical shaped pad member vertically positioned above said horizontal base member; and means for securing said cylindrical shaped pad member in a vertical position above said horizontal base member.

2. The exercise apparatus of claim 1 further comprising at least one lateral handle bar attached to said cylindrical shaped pad member.

3. The exercise apparatus of claim 1 further comprising means for adjusting the vertical position of said cylindrical shaped pad member above the horizontal base member.

4. The exercise apparatus of claim 1 wherein said support plate is adjustable along a length of said horizontal base member thereby creating an apparatus with an adjustable length.

5. The exercise apparatus of claim 1 wherein said means for securing said cylindrical shaped pad member in its vertical position above said horizontal base member comprises at least one bar member extending between said horizontal base member and said cylindrical shaped pad member.

6. The exercise apparatus of claim 5 wherein said at least one bar member extends from said horizontal base member at an angle less than 90° and said means for securing said cylindrical shaped pad member in its vertical position further comprises a vertical support bar member extending between said horizontal base member and said at least one bar member.

7. The exercise apparatus of claim 5 wherein said at least one bar member is adjustable in length.

8. The exercise apparatus of claim 1 wherein said foot plate comprises a heel stop plate for retaining a user's heels.

* * * * *